US010179420B2

(12) United States Patent
Cros et al.

(10) Patent No.: US 10,179,420 B2
(45) Date of Patent: Jan. 15, 2019

(54) SAFETY COVER FOR LIGHTNING PUNCH

(71) Applicants: Laurent Cros, Gloucester, MA (US); Nicholas C. Green, Cayuga, NY (US)

(72) Inventors: Laurent Cros, Gloucester, MA (US); Nicholas C. Green, Cayuga, NY (US)

(73) Assignee: Pearl Technologies Inc., Savannah, NY (US)

( * ) Notice: Subject to any disclaimer, the term of this patent is extended or adjusted under 35 U.S.C. 154(b) by 131 days.

(21) Appl. No.: 15/499,328

(22) Filed: Apr. 27, 2017

(65) Prior Publication Data

US 2018/0311854 A1 Nov. 1, 2018

(51) Int. Cl.

| | |
|---|---|
| ***B26D 7/22*** | (2006.01) |
| ***B26D 7/26*** | (2006.01) |
| ***B26D 9/00*** | (2006.01) |
| ***B26D 7/18*** | (2006.01) |
| ***B26D 7/02*** | (2006.01) |

(52) U.S. Cl.

CPC ..... *B26D 7/2614* (2013.01); *B26D 7/025* (2013.01); *B26D 7/1854* (2013.01); *B26D 7/22* (2013.01); *B26D 9/00* (2013.01)

(58) Field of Classification Search

CPC .... B26D 7/2614; B26D 7/1854; B26D 7/025; B26D 7/22; B26D 7/00

USPC ..... 83/167, 586–587, 139

See application file for complete search history.

(56) References Cited

U.S. PATENT DOCUMENTS

| | | | | |
|---|---|---|---|---|
| 3,871,254 | A * | 3/1975 | Whistler, Jr. | B21D 28/34 83/139 |
| 6,148,710 | A | 11/2000 | Pottorff | |
| 6,152,299 | A | 11/2000 | O'Malley et al. | |
| 6,311,789 | B1 | 11/2001 | Saxman | |
| 6,923,099 | B2 | 8/2005 | Rugg et al. | |
| 7,080,585 | B2 | 7/2006 | Prudhomme | |
| 7,228,921 | B1 | 6/2007 | Houg et al. | |
| 8,360,237 | B2 | 1/2013 | Weaver et al. | |
| 8,443,972 | B1 | 5/2013 | Pendergraph et al. | |
| 2009/0127145 | A1 | 5/2009 | Nonaka et al. | |
| 2013/0233135 | A1 * | 9/2013 | MacFarlane | B26D 3/167 83/13 |

FOREIGN PATENT DOCUMENTS

JP 07009391 A * 1/1995

* cited by examiner

*Primary Examiner* — Ghassem Alie
*Assistant Examiner* — Nhat Chieu Do
(74) *Attorney, Agent, or Firm* — Bernhard P. Molldrem, Jr.

(57) ABSTRACT

A safety cover is provided for a cutter head or punch head of the type used in making holes and slits in plastic film, so that the punch head may be transported, stored, installed or removed without exposing the sharp cutting blades to an operator's hands. The safety cover may be of a box-like construction with a generally keyhole-shaped opening formed on its upper wall. The keyhole opening has a wider portion open to the distal or machine side, a narrow slot portion, and a round portion that accommodates the round punch blade of the punch head.

6 Claims, 7 Drawing Sheets

SAFETY COVER FOR LIGHTNING PUNCH

BACKGROUND OF THE INVENTION

This invention relates to plastic film handling and processing equipment, and is more specifically directed to improved plastic film punch equipment for making holes, openings, and/or slits in one or more layers of a plastic film. The invention is more particularly concerned with an improved carrier or holder for a punch head that permits the punch head to be handled safely when storing or transporting the punch head, and when inserting it into or removing it from the punch equipment.

Hole punches and slitter punches are used in bag making machines or the like for punching holes and/or slits in a web of plastic film material. Favorably, a hole punch and a slitter blade are unitarily formed on a base member, to provide a punch unit that can be slid into a quick adapter. The latter typically has a T-slot channel to receive the base of the punch unit with the punch head and slitter blade extending downwards towards a backing plate. The quick adapter is mounted on a rod of a high speed pneumatic cylinder of the punch equipment. The hole punch/slitter punch base unit also has a pair of resilient arms with protruding detents that fit into side recesses in the T-slot channel to hold the punch securely in place in the holder for punching operations. The two resilient arms can be squeezed to disengage the detents from the side recesses and allow the unit to be pulled proximally out of the holder when the punch unit needs to be changed or replaced.

Punch equipment and slitter punches of this type are described in some detail in prior U.S. Pat. No. 6,148,710 to Pottorff, and in prior U.S. Pat. No. 7,080,585 to Prudhomme. The descriptions contained in those two patents are incorporated by reference herein, as background for the types of equipment and punches that provide environment for the safety cover of the present invention.

The cutting edges of the round punch head and associated slitter blade may be quite sharp, and pose a danger to the fingers of the technician when inserting or removing the cutter head into the punching machine. This is also the case for persons carrying the punch units or in packaging or handling them as supply items.

An effective, low-cost but reliable cover was needed that can protect the sharp cutter blade and/or slitter blade from damage in storage or shipment or installation, and can also prevent injury from handling the cutter blade and/or slitter blade when installing the units into the punch equipment and when removing it from the punch equipment.

The equipment that may be associated with which the punch apparatus of this invention may include a bag machine or similar machine in which where the plastic film is prepared for fabrication into bags, protective sleeves, or other plastic film products.

Punches for bag making machines, in which flexible plastic film is cut and/or in which holes or openings are formed in the film, typically have a pneumatic cylinder or other reciprocating device positioned above an apertured backing plate. The web of plastic film is drawn in across the backing plate. The cylinder rod supports a carrier into which the cutting head is placed. The cutting head or punch head may have cutter blades and/or slitter blades of steel, brass, or in some cases plastic. The profile of the cutting head is the shape of the hole that is to be formed in the plastic film. When the film reaches the position where the hole is to be punched, the film transport motion is stopped, and the hole is punched by actuating the air cylinder. A hold-down clamp descends and holds the film in place on the backing plate. The cylinder pushes the head into the film so that it penetrates the film, and enters into an aperture in the backing plate, to cut the desired opening. In the case of a slitter punch, the slitter blade forms a slit at a given position relative to the round opening. Then the head rises back up, the hold-down clamp releases the web of film, and the film moves to the place where the next hole is to be formed. Then the process is repeated. The cut-away circles of plastic film, i.e., "slug", drop into a waste tube below the apertured backing plate, and can be conducted away, and later recycled or disposed of. The rapid, repeated motion of the round hole punch and the slitter blade into the plastic film will cause wear on the sharp edges of the blade, eventually affecting the performance of the punch and requiring the head to be replaced. Also, when the equipment need to be reconfigured for a different hole punch job, it is usually necessary to remove the punch head, and replace it with a different one with the prescribed hole size and slit size for the subsequent job. Thus there is frequently a need for a technician or other workman to handle these sharp items, remove them from the machine and replace them with a different unit.

OBJECTS AND SUMMARY OF THE INVENTION

Accordingly, it is an object of this invention to provide an improvement for the punch head(s) for reciprocating punch equipment used for forming holes, openings, and/or slits in a web of plastic film.

It is more particular object to provide a punch head arrangement that improves the safety in storing and handling these sharp items.

It is another object of the invention to provide holder for a slitter punch head so that the unit can be safely shipped, stored, and handled.

According to one aspect of the present invention, a safety cover is adapted to snap in place onto a cutter head of this type, and serves to protect the sharp blades of the cutter head and to protect the persons handling them, including persons installing or removing the cutter head. The safety cover is adapted for suitable use with a punch head for a plastic film slitter punch that is comprised of an upper plate member that slides into and is removably retained in a channel of a punch head holder, deflectable members that removably engage a detent in the holder, a horizontal leg extending distally from the upper plate, and at least a round punch blade depending from the upper plate and adapted for cutting holes in the film The cutting head frequently includes a flat slitter blade as well. In several preferred embodiments, the safety cover can include an upper wall, a proximal end wall having its upper edge joined to the proximal edge of the upper wall, and a bottom wall generally coextensive with the upper wall and parallel to it, and having its proximal edge joined to a lower edge of the proximal wall. In order to accommodate the cutter head, the upper wall has a keyhole-shaped opening, where the opening has a distal portion, which can be generally triangular, i.e., wider to the distal part of the opening, where the distal part opens to a distal end of the upper wall, a generally straight slot having a width, and extending proximally from the distal portion in said upper wall, and a round portion at a proximal end of the straight slot with a greater diameter than the width of the straight slot. The safety cover is adapted and configured to flex sufficiently so that the straight slot opens to permit proximal-distal passage of the round punch blade therethrough and can restore itself to an unflexed state in which the straight slot width generally matches the width of said horizontal leg of the cutter head. The safety cover is configured to fit either the type of cutter head with forward projecting flexible arms as depicted in the aforesaid U.S. Pat. Nos. 6,148,719 and 7,080,585, or a type if cutter head with the spring arms projecting back or distally, as depicted in this patent description, or other designs of cutter head.

The above and many other objects, features, and advantages of this invention will become apparent from the ensuing description of an exemplary embodiment, which should be read in conjunction with the accompanying Drawing.

DETAILED DESCRIPTION OF THE PREFERRED EMBODIMENTS

Figure 1:
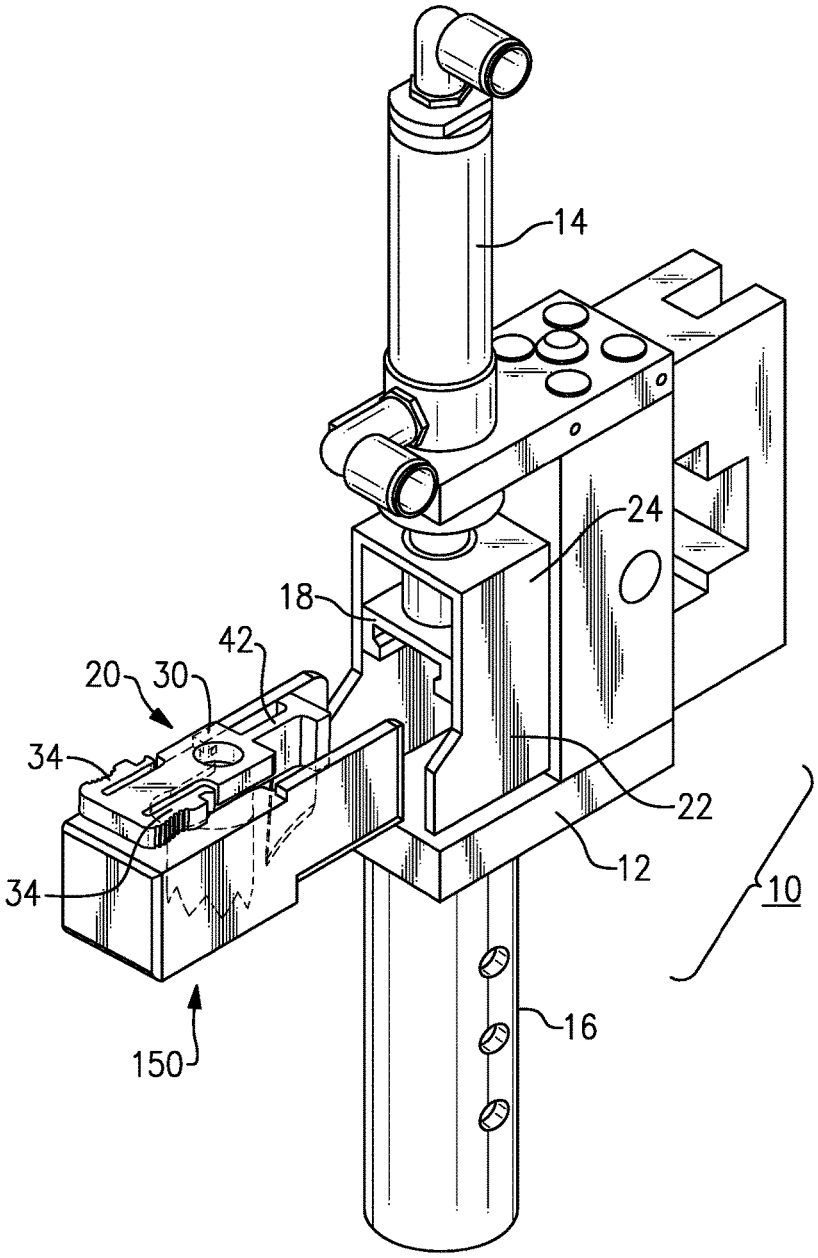
FIG. 1 is a perspective view of a hole and slit punch arrangement wherein a cutting head is held in a safety cover according to one preferred embodiment of the invention.

With reference to the Drawing, FIG. 1 illustrates a punch arrangement 10 that is used for punching holes and/or slits in a web of plastic film. The construction of the punch arrangement 10 is described in detail in the aforesaid U.S. Pat. No. 7,080,585. There is an apertured backing plate 12 on which the film rests when the hole and/or slit is formed in it. A reciprocating actuator 14, to with a vertical double-action pneumatic cylinder, is positioned on a frame above the backing plate, and a waste tube 16 is situated beneath the backing plate 12 to catch and retain the material that is punched out of the plastic film. A holder 18 with a T-channel slot is mounted on a shaft or rod of the actuator, and a slitter punch head 20 is received in the T-channel slot and is held in place in the holder 18 during a punching operation.

A film clamp or hold-down assembly 22 is mounted over the actuator shaft and has a vertical frame 24 positioned over the sides of the holder 18. This assembly 22 serves to clamp the film workpiece against the backing plate when the holder 18 and head 20 descend, and rises thereafter to release the film so it can move to the position of a subsequent hole and/or slit.

Figure 5:
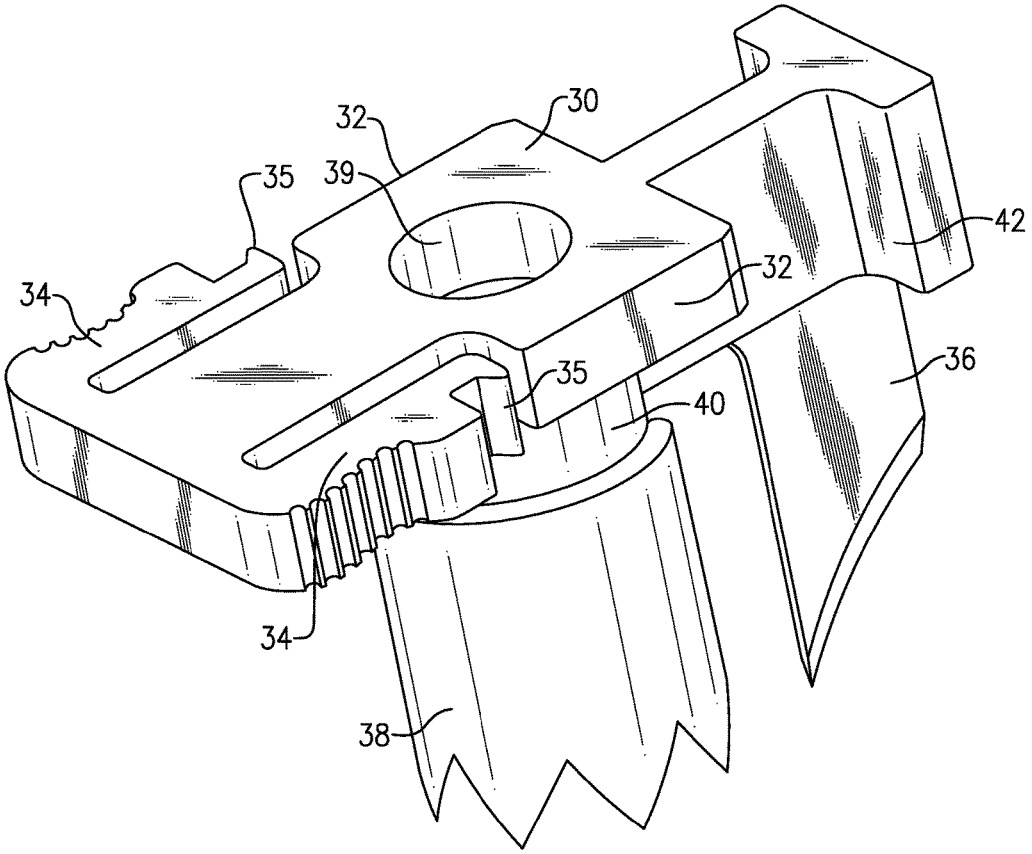
FIG. 5 is a perspective view of a punch cutter head explaining detail in the structure thereof.

The depicted cutter head or punch head 20 has an upper plate or base 30 with a pair of side edges 32 that slide into the side recesses of the T-channel slot in the holder 18. Details of this cutter head can be seen in FIG. 5. There are a pair of spring arms 34 with detents 35 that lodge in recesses (not shown here) within the T-channel to maintain the head in place. A knife blade or slitter 36 and round punch blade 38 are supported beneath the base 30. As shown here a neck 40, which may have a smaller diameter than the punch blade 38, supports the punch blade, and a T-shaped leg 42 extends distally from the neck 40 and from the base 30, with the slitter blade 36 projecting downward from the T-shaped leg. An opening 39 in the base plate extends to the inside of the punch blade 38 and admits pulses of air to drive the punched-out material into the waste tube 16.

Returning to FIG. 1, a safety cover 150 is shown holding the slitter punch head 20 with the base 30 over the top of the cover 150, and with the round punch blade and the cutter blade concealed within the cover. This safety cover slides into the punch arrangement within the hold down assembly 22 and just beneath the holder 18, to position the punch head 20 so that the base 30 thereof slides into the T-channel slot of the holder.

Figure 2:
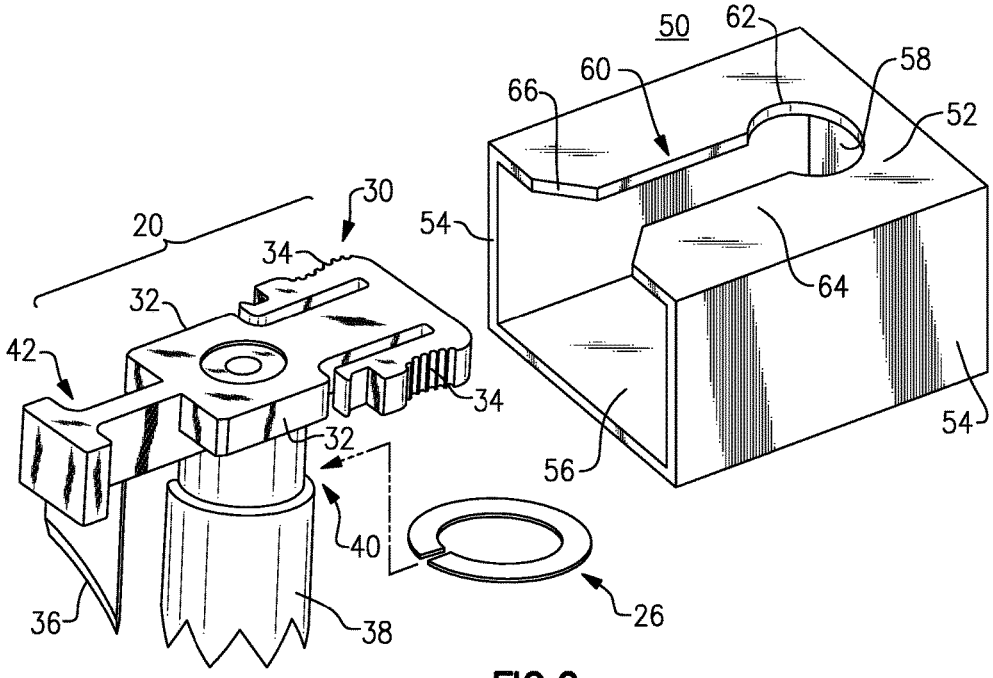
FIGS. 2 and 3 are perspective views of the safety cover according to other possible embodiments of the invention.
Figure 3:
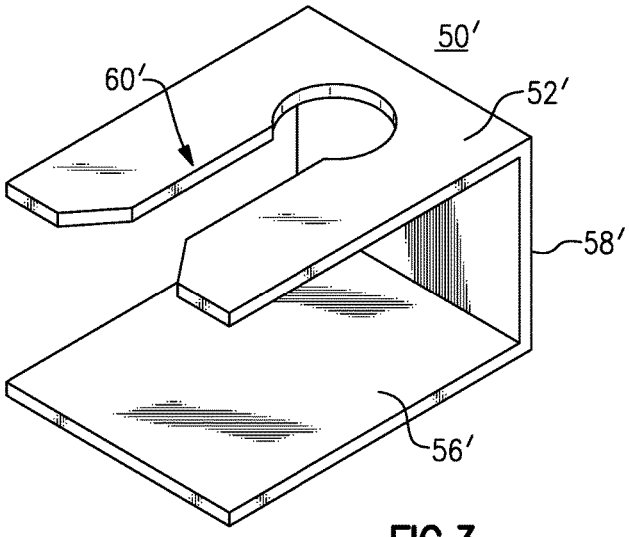

A simple embodiment of the safety holder is illustrated in FIG. 2, and another simple embodiment thereof is shown in FIG. 3.

In FIG. 2, a safety cover 50 has a top wall 52, a pair of side walls 54, 54, a bottom wall 56, and a proximal end wall 58. Here, "proximal" means the direction facing the operator installing or removing the slitter punch cutter head 20, and "distal" means the direction towards the machine. A keyhole shaped opening 60 on the top wall 52 is configured to receive the slitter blade 40 and hole punch blade 38 of the punch. The opening 60 is provided with a generally circular opening 62 towards the proximal side of the top wall, an elongated slot 64, and beveled-out distal edges 66 to create a generally triangular mouth portion for the opening 60. The safety cover is made of a material with sufficient resilient flexibility so as to allow the opening 60 to flex and allow passage therethrough of the round punch blade or its supporting neck, and to snap back so that the narrow slot 64 holds against the T-shaped leg 42 of the punch head. An optional construction for safety cover 50' is shown in FIG. 3, wherein the safety cover is provided with a top wall 52', a proximal vertical wall 58', and a lower or bottom wall 56', with the sides and distal end left open. Here the keyhole shaped opening 60' is present in the upper or top wall 52', as previously discussed. This construction will protect the operator from the sharp edges of the punch blade and the slitter blade when installing the head into the machine or removing it from the machine.

As also shown in FIG. 2, an optional split ring 26 may be present on the neck 40 of the round punch blade 38, in cases where a shoulder or flange is needed below the lower side of the top wall to prevent the safety cover from slipping and falling off the slitter punch head 20.

Figure 4A:
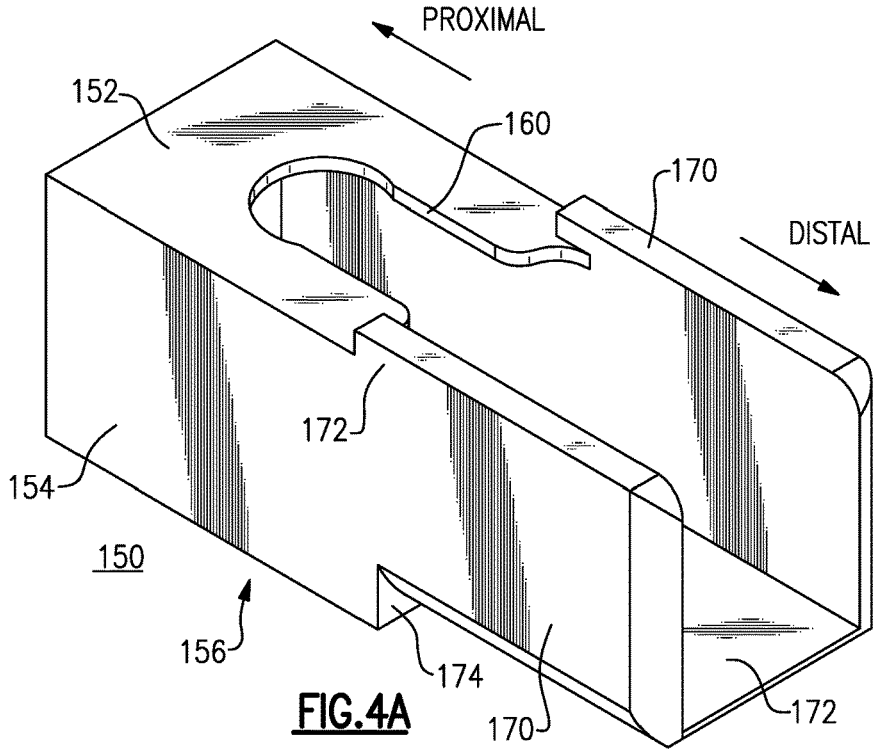
FIGS. 4A and 4B are opposite perspective views of the safety cover according to the first aforesaid embodiment.
Figure 4B:
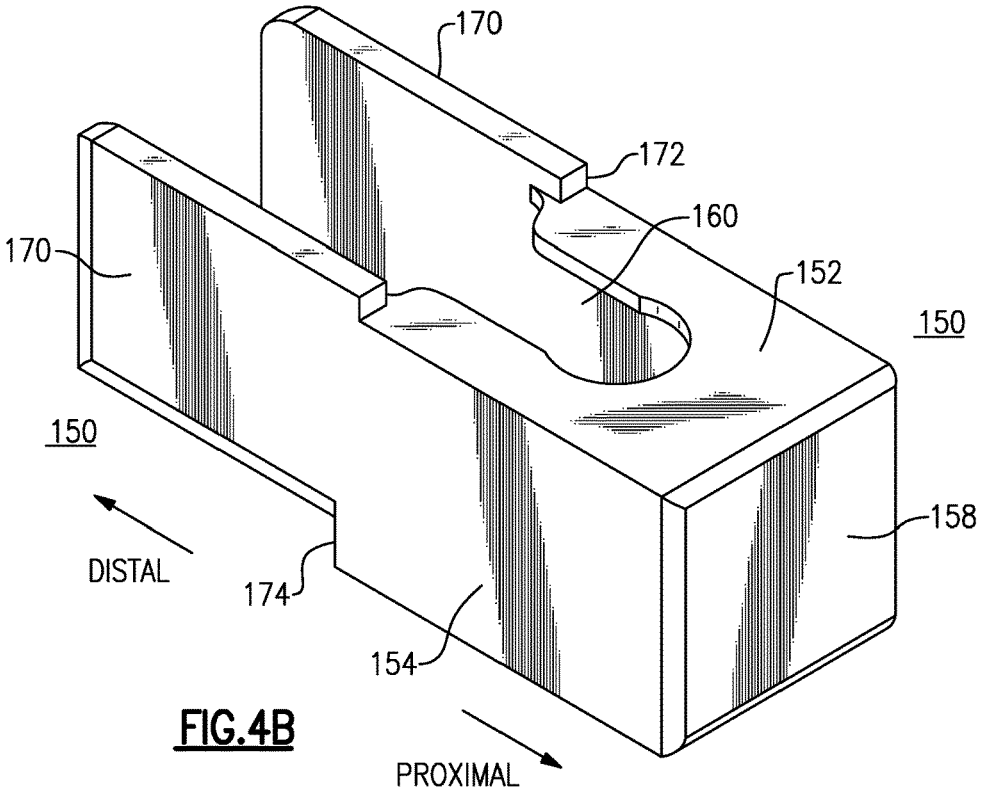

A preferred arrangement of the safety cover 150 is shown in a distal perspective in FIG. 4A and in a proximal perspective in FIG. 4B. The safety cover 150 is generally configured as a square section box, with a top wall 152, side walls 154 and a bottom wall 156, and with a keyhole opening 160 formed in the top or upper wall 152. In this embodiment, the side walls have extensions 170 in the distal direction with an upper stepped flange portion 172 that is raised above the level of the upper wall 152, and also with a planar base portion that is stepped above the bottom wall 156, and forming a step 174 at the junction of the extensions 170 with the main side walls 154, as shown. The top wall 152, side walls 154, and bottom wall 156 are each generally planar, as shown, and a square generally planar proximal end wall 158 is joined to proximal edges of the top wall 152, side walls 154, and bottom wall 156. These features allow the cover to be pushed in on top of the backing plate 12 and under the holder 18 so that the cover is in proper position for installation or removal of the punch head or cutter head without exposing the operator's hands to the sharp edges of the blades 38, 36.

Figure 6:
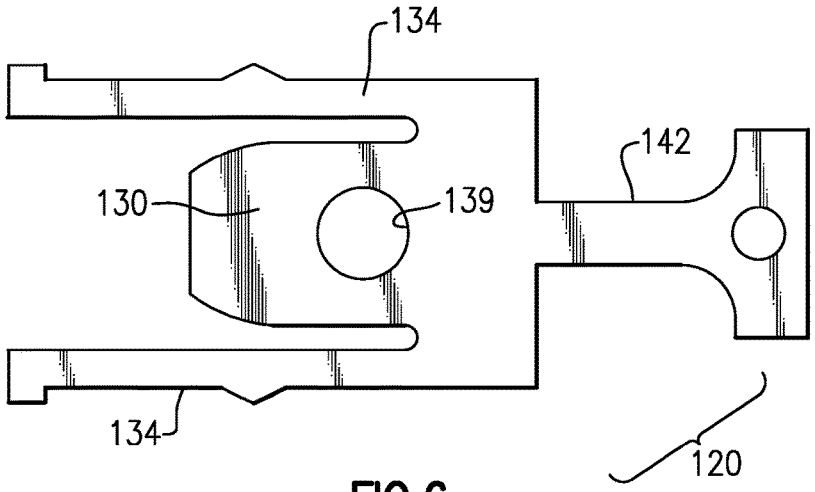
FIGS. 6 and 7 are a top plan and a perspective of a punch cutter head according to another construction.
Figure 7:
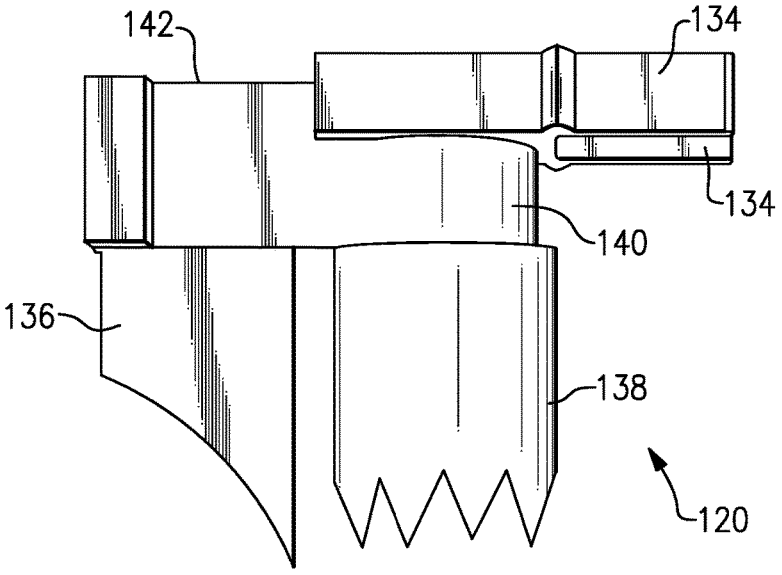
Figure 8:
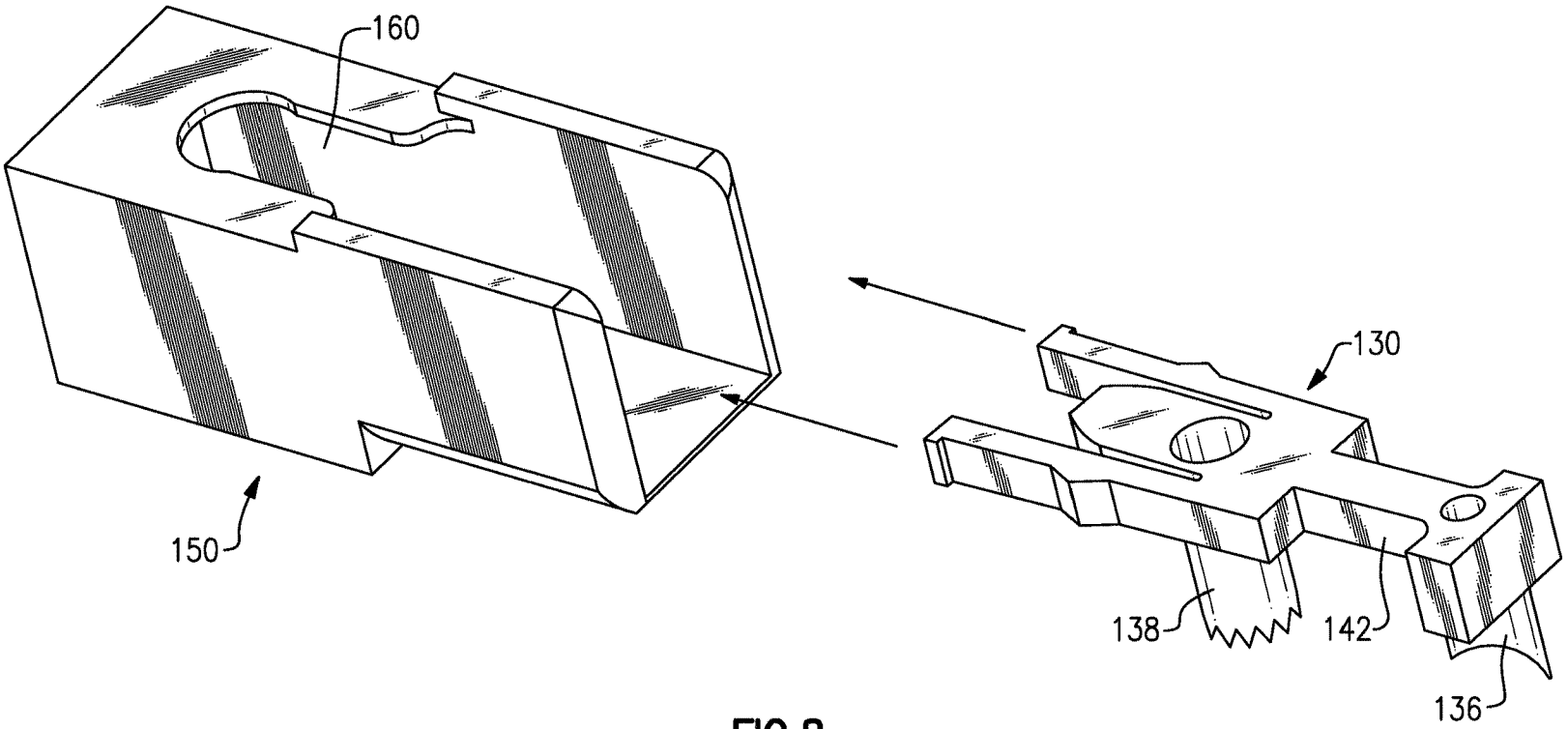
FIG. 8 is an exploded view explaining how the cutter head slides into place in the safety cover of the first embodiment.

An alternative embodiment of the slitter punch head or cutter head 120 appears in FIGS. 6 and 7, which also seats in the T-channel of the holder 18 in a similar fashion to the first-described punch head 20, and fits the same safety cover or covers 50, 50', 150. The difference here is in the base 130 and spring arms 134. The base 130 supports the round punch blade 138 and the T-shaped leg 142 extends distally and supports the slitter blade 136. The spring arms 134 here project forward or proximally from the base, and detents in the sides of these arms lodge into the recesses in holder T-channel. Like the first-described punch head, an opening 139 permits compressed air into the hollow interior of the round punch blade 138 to blow plastic waste into the waste tube 16.

Figure 9:
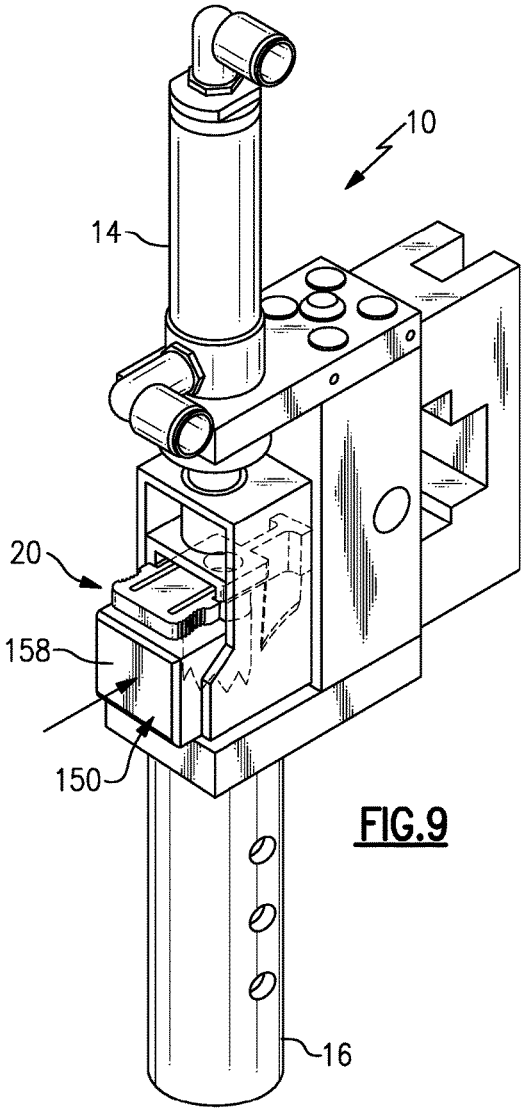
FIG. 9 and FIG. 10 are perspective views of the hole and slot punch arrangement showing the cutter head being inserted in place into the carrier or holder, and showing the safety cover being thereafter removed, respectively.
Figure 10:
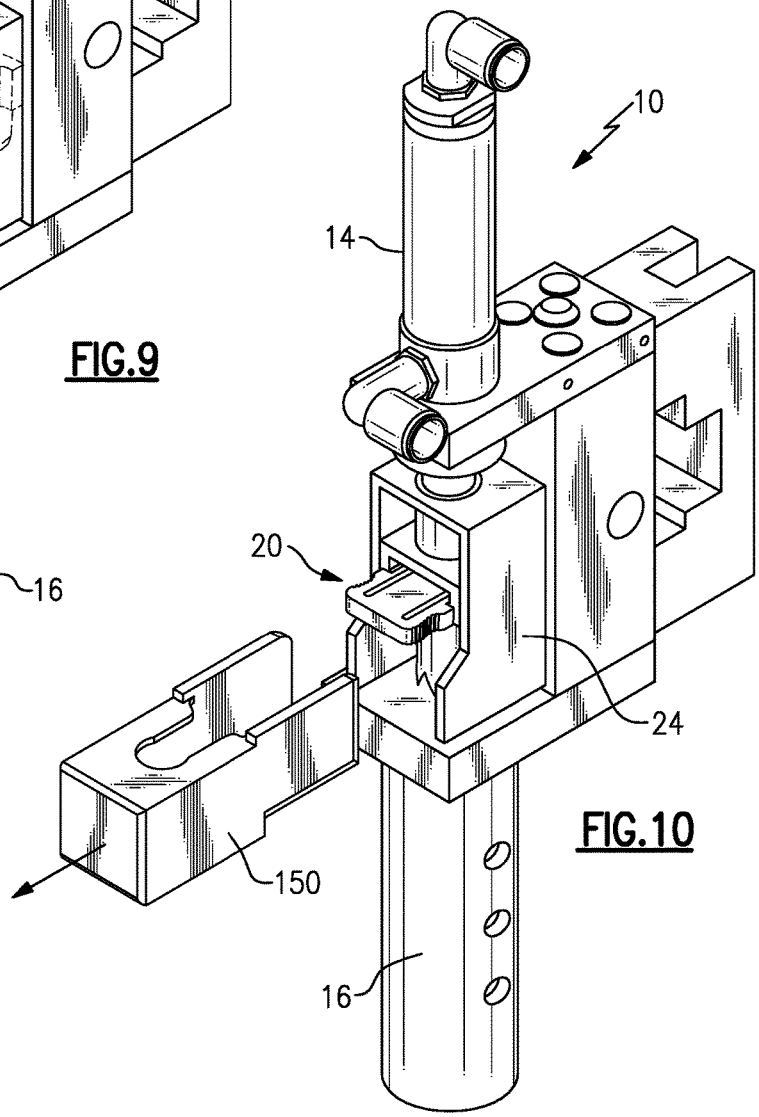

FIGS. 9 and 10 help explain the use of the cover in the installation of the punch head into the apparatus. As shown in FIG. 9, the cutter head 20 is inserted into the holder 18 by pushing against the proximal wall 158 of the safety cover. This inserts the punch head base 30 into the T-slot until the detents lodge in place in the respective recesses. Then the operator can grip the sides of the cover 150 and draw it out to proximal, as shown in FIG. 10, leaving the punch head in place in the holder. To remove the punch head, the process is reversed, and the empty safety cover 150 is pushed into place around the punch head 20 until the round punch blade snaps in place within the keyhole opening. Then the operator pinches the two spring arms to release the detents, and the cover can be pulled out with the punch head contained inside it.

Many other configurations are possible for the punch heads and for the associated safety covers. In preferred embodiments, a clear or translucent plastic material is used for the safety cover, so that the blades of the punch head are visible when the assembly of the punch head and cover is being handled.

While the invention has been described in respect to a preferred embodiment, it is to be understood that the invention is not limited to that embodiment. Rather, many modifications and variations of this pivot punch are possible according to the principles of this invention, which is to be reckoned in accordance with the accompanying claims.

What is claimed is:

1. In combination, a plastic film slitter punch comprising:

a punching head having an upper plate member that slides into and is removably retained in a channel of a punch head holder, wherein the upper plate member comprises deflectable members removably engaging a detent in said punch head holder, and at least a round punch blade extending from said upper plate member and adapted for cutting holes in said plastic film; and a safety cover removably covering a cutting edge of said cutting head for transporting or storing, comprising:

an upper wall;

a proximal end wall having an upper edge joined to a proximal edge of said upper wall, and a bottom wall generally coextensive with said upper wall and parallel thereto and having a proximal edge joined to a lower edge of said proximal end wall; and wherein said upper wall has a keyhole-shaped opening thereon, including a distal portion opening at a distal end of said upper wall, a generally straight slot having a width and extending proximally from said distal portion in said upper wall, and a round portion at a proximal end of said straight slot and having a greater diameter than the width of said straight slot, and wherein said upper wall is adapted to flex sufficiently so that the straight slot opens to permit proximal-distal passage of said round punch blade therethrough and restore to an unflexed state; and so that when the punch head is used, the safety cover is removed.

2. The combination according to claim 1 wherein said distal portion of said keyhole-shaped opening is triangular in shape.

3. The combination according to claim 1 comprising left and right side walls extending from said proximal end wall and extending between said upper wall and said bottom wall.

4. The combination according to claim 3 wherein said left and right side walls have extending portions that extend distally for a predetermined distance beyond a distal edge of said upper wall, and said wherein said extending portions include a flange portion that extends therealong to a distal end thereof, and which protrudes a predetermined distance above a top surface of said upper wall.

5. The combination according to claim 4 including a lower wall extending horizontally between lower edges of said extending portions.

6. The combination according to claim 1 wherein said plastic film slitter punch includes a horizontal leg extending distally from said upper plate, and said straight slot width in said upper wall aligns with said horizontal leg.

* * * * *